US006603940B2

(12) United States Patent
Funayama et al.

(10) Patent No.: US 6,603,940 B2
(45) Date of Patent: Aug. 5, 2003

(54) DETACHABLE PROCESS CARTRIDGE FOR IMAGE FORMING APPARATUS

(75) Inventors: Naotaka Funayama, Tenri (JP); Jun Yamaguchi, Ikoma (JP); Yoshiaki Sanada, Ikoma (JP); Tsutomu Nagata, Hirakata (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/985,896

(22) Filed: Nov. 6, 2001

(65) Prior Publication Data

US 2002/0048467 A1 Apr. 25, 2002

(30) Foreign Application Priority Data

Nov. 9, 2000 (JP) ..... 2000-342712

(51) Int. Cl.[7] ..... G03G 15/08
(52) U.S. Cl. ..... 399/119; 399/120; 399/262
(58) Field of Search ..... 399/119, 120, 399/262

(56) References Cited

U.S. PATENT DOCUMENTS 4,974,023 A * 11/1990 Aimoto et al. ..... 399/119
5,604,572 A * 2/1997 Suzuki et al. ..... 399/119
6,038,416 A * 3/2000 Okano et al. ..... 399/119

FOREIGN PATENT DOCUMENTS

JP 2-141777 * 5/1990
JP 5-197227 * 8/1993

* cited by examiner

*Primary Examiner*—William J. Royer
(74) *Attorney, Agent, or Firm*—Birch, Stewart, Kolasch & Birch, LLP

(57) ABSTRACT

A process cartridge includes a toner unit including a toner containing space and a toner supply space. A development unit including rollers. There is a holding frame having a fixture section for the development unit and an accepting section for the toner unit. The process cartridge is constructed arrangement in which the toner is fixed in a predetermined position in the accepting section of the holding frame or which the toner unit is detachably installed in a predetermined position in the accepting section of the holding frame.

17 Claims, 10 Drawing Sheets

DETACHABLE PROCESS CARTRIDGE FOR IMAGE FORMING APPARATUS

BACKGROUND OF THE INVENTION

1. Field of the Invention

The present invention relates to a detachable process cartridge for use in image forming apparatuses, such as copying machines, printers and facsimile machines, and also relates to image forming apparatuses using this process cartridge.

2. Description of the Prior Art

Image forming apparatuses, such as copying machines, printers and facsimile machines, form an image through an exposure process of forming an electrostatic latent image by exposure of the surface of a photoreceptor, such as a photosensitive drum and a photosensitive belt, to light; a development process of visualizing the formed electrostatic latent image by deposition of toner; a transfer process of transferring a toner image formed on the photoreceptor surface by development to a predetermined sheet; and a fixing process of fixing the toner image transferred to the sheet by application of heat. The above exposure, development and transfer processes are sequentially carried out at an exposure section, a development section and a transfer section, respectively, which are provided on the periphery of the photoreceptor. Moreover, a cleaning section for removing toner remaining on the photoreceptor surface after the transfer process and a charging section for uniformly charging the surface before exposure are provided on the periphery of the photoreceptor.

Image forming apparatuses of this type are mainly classified into two kinds of structures according to the maintenance methods. The first structure is a CRU (Customer Replaceable Unit) structure whose maintenance is performed mostly by the user. The second structure is an SRU (Serviceman Replaceable Unit) structure whose principal maintenance is carried out by a special serviceman.

In an image forming apparatus of the CRU structure, many of the process means, such as the above-mentioned development section, charging section and cleaning section, for performing the respective processes with respect to the photoreceptor are constructed as cartridges (process cartridges) which are attachable and detachable to/from the periphery of the photoreceptor in the main body of the apparatus. When some troubles occur in the processes, corresponding process cartridges are detached. Minor troubles are solved by making simple adjustments. On the other hand, when a severe trouble occurs, a corresponding cartridge as a unit is replaced.

In recent years, composite type image forming apparatuses having all the functions as a copying machine, printer and facsimile machine rather than an exclusive function of such an individual device have been put into practical application. This type of image forming apparatus is an apparatus for personal use designed for use by a person or a small number of people. Further, in order to improve the usability related to maintenance, this type of image forming apparatus often adopts the CRU structure.

Here, the development section for the development process is constructed by a development roller that is adjoined the surface of the photoreceptor to face the photoreceptor and rotates about an axis parallel to the surface, and agitating means provided on the side opposite to the development roller. The development roller is a magnet roller incorporating a magnet. Toner for use in development is mixed with a carrier made of a magnetic powder and agitated by the action of the agitating means, and the resultant mixture is used as a developer. The toner is deposited on the entire surface of the development roller and transferred to a section opposing the photoreceptor. The toner is attracted and moved to an electrostatic latent image formed on the surface of the photoreceptor, thereby forming a toner image.

In the above-described image forming apparatus of the CRU structure, the process cartridge of the development section is constructed by integrating a development unit comprising the development roller and agitating means and a toner unit including a container for containing toner for development and toner supply means as disclosed in Japanese Patent Application Laid-Open Nos. 5-197227/1993 and 2-141777/1990. When the toner is run out by repetition of the development process, the toner is readily replaceable by replacing the cartridge as a unit.

On the other hand, in an image forming apparatus of the SRU structure, many of process means including the development section are highly accurately positioned and fixed on the periphery of the photoreceptor in the main body of the apparatus. This structure has been widely adopted by image forming apparatuses, such as apparatuses serving as copying machines exclusively, which are designed to meet a demand for supply of a large volume of good quality printed matter at a low unit cost. Besides, image forming apparatuses of the SRU structure can handle various kinds of troubles by adjustments and replacement of the respective process means which are carried out by periodical maintenance work of special servicemen, thereby keeping good image quality for a long time.

Note that, even in such an image forming apparatus of the SRU structure, replacement of toner in the development section is necessary. In this case, toner replacement is performed by detaching the fixed toner unit comprising the toner containing space and the toner supply means from the development section.

By the way, in order to shorten the development period and rationalize the design aspect, attempts to share major process means between the above-described image forming apparatuses of the CRU structure and image forming apparatuses of the SRU structure have been conventionally made. Various types of sharable process means have been prepared for each process means so that they are selected according to the applications and purposes and combined for use.

However, regarding the development section for the development process, if the process means is to be shared between the apparatuses of the CRU structure in which the development unit and the toner unit are coupled as an integrated device as described above and the apparatuses of the SRU structure in which these units need to be separated, then the structure relating to the separation/coupling becomes complicated. Moreover, there are problems that complicated manufacturing processes and an increase in the manufacturing cost would result from problems associated with accuracy.

Furthermore, in image forming apparatuses of the SRU structure, a complicated attachment/detachment structure of the toner unit with respect to the fixed development unit is unavoidable, resulting in a problem that the user is forced to carry out complicated processes to replace the toner.

BRIEF SUMMARY OF THE INVENTION

The present invention has been made with the aim of solving the problems. An object of the present invention is to provide a process cartridge capable of certainly achieving separation/coupling of a development unit and a toner unit with a simple structure and realizing sharing of a development section between the CRU structure and the SRU structure with high accuracy without making the manufacturing processes complicated or increasing the manufacturing costs. It is also an object of the present invention to provide an image forming apparatus implemented using this process cartridge.

A process cartridge according to the present invention comprises: a toner unit including a toner containing space and a toner supply section; a development unit including a developing device; and a holding frame including a fixture section for the development unit and an accepting section for the toner unit, and is characterized in that the process cartridge is constructed selectively in a first arrangement in which the toner unit is fixed in a predetermined position in the accepting section of the holding frame or in a second arrangement in which the toner unit is detachably installed in the predetermined position.

In this invention, the development unit is fixed, the holding frame having an accepting section for the toner unit is provided, and the toner unit is fixed in the accepting section of this holding frame. Moreover, the process cartridge can correspond to the CRU structure by the first arrangement in which the toner unit and the development unit are integrated through the holding frame. Furthermore, the process cartridge can correspond to the SRU structure by the second arrangement in which the toner unit is detachably installed in the accepting section of the holding frame integrated with the development unit. Accordingly, sharing of the process cartridge for use in the development process is realized.

Besides, a process cartridge according to the present invention is characterized in that the holding frame includes a fixture section for fixing the toner unit to the predetermined position, and guide sections for guiding the toner unit to the predetermined position.

In this invention, by selectively using the fixture section and guide sections formed on the holding frame, it is possible to select the first arrangement in which the toner unit is fixed or the second arrangement in which the toner unit is detachably installed.

Moreover, a process cartridge according to the present invention is characterized in that the holding frame includes a guide section for guiding itself to an appropriate position in an image forming apparatus main body in which the process cartridge is to be installed, and a fixture section for fixing itself to the appropriate position.

In this invention, by selectively using the fixture section and guide sections formed on the holding frame, it is possible to easily realize the CRU structure where the holding frame in which the development unit and the toner unit are integrated is attached and detached with respect to the main body of the image forming apparatus and the SRU structure where the toner unit is attached and detached with respect to the holding frame which is fixed to the main body of the image forming apparatus together with the development unit.

An image forming apparatus according to the present invention comprises a receiving section for receiving a holding frame of a process cartridge of the present invention constructed in the first arrangement, and is characterized by replacement of toner and developer performed by detachment and attachment of the holding frame with respect to the receiving section.

An image forming apparatus according to the present invention is characterized by fixing a holding frame of a process cartridge of the present invention constructed in the second arrangement to a predetermined position therein, and replacement of toner performed by detachment and attachment of the holding frame with respect to the holding frame.

According to these inventions, it is possible to easily realize image forming apparatuses of the CRU structure and the SRU structure.

A process cartridge according to the present invention comprises: a toner unit including a toner containing space and a toner supply section; and a development unit including a developing device, and is characterized in that the process cartridge is constructed selectively in a "third arrangement (main arrangement)" in which the toner unit and the development unit are fixed or in a "fourth arrangement (sub-arrangement)" in which the toner unit and the development unit are detachably attached.

In this invention, the process cartridge can correspond to the CRU structure by the third arrangement in which the development unit and the toner unit are integrated by fixation. Moreover, the process cartridge can correspond to the SRU structure by the fourth arrangement in which the development unit and the toner unit are mutually attachable and detachable. Accordingly, sharing of the process cartridge for use in the development process is realized.

A process cartridge according to the present invention is characterized in that the toner unit further comprises a waste toner storing space for storing toner collected as non-transfer toner.

An image forming apparatus according to the present invention comprises a receiving section for receiving a process cartridge of the present invention constructed in the third arrangement and fourth arrangement, and is characterized in that the toner unit and the development unit are attachable and detachable as one unit or separate units with respect to the receiving section.

According to this invention, it is possible to realize image forming apparatuses of the CRU structure and the SRU structure with simple structures.

The above and further objects and features of the invention will more fully be apparent from the following detailed description with accompanying drawings.

DESCRIPTION OF THE PREFERRED EMBODIMENTS

Embodiment 1

Figure 1:
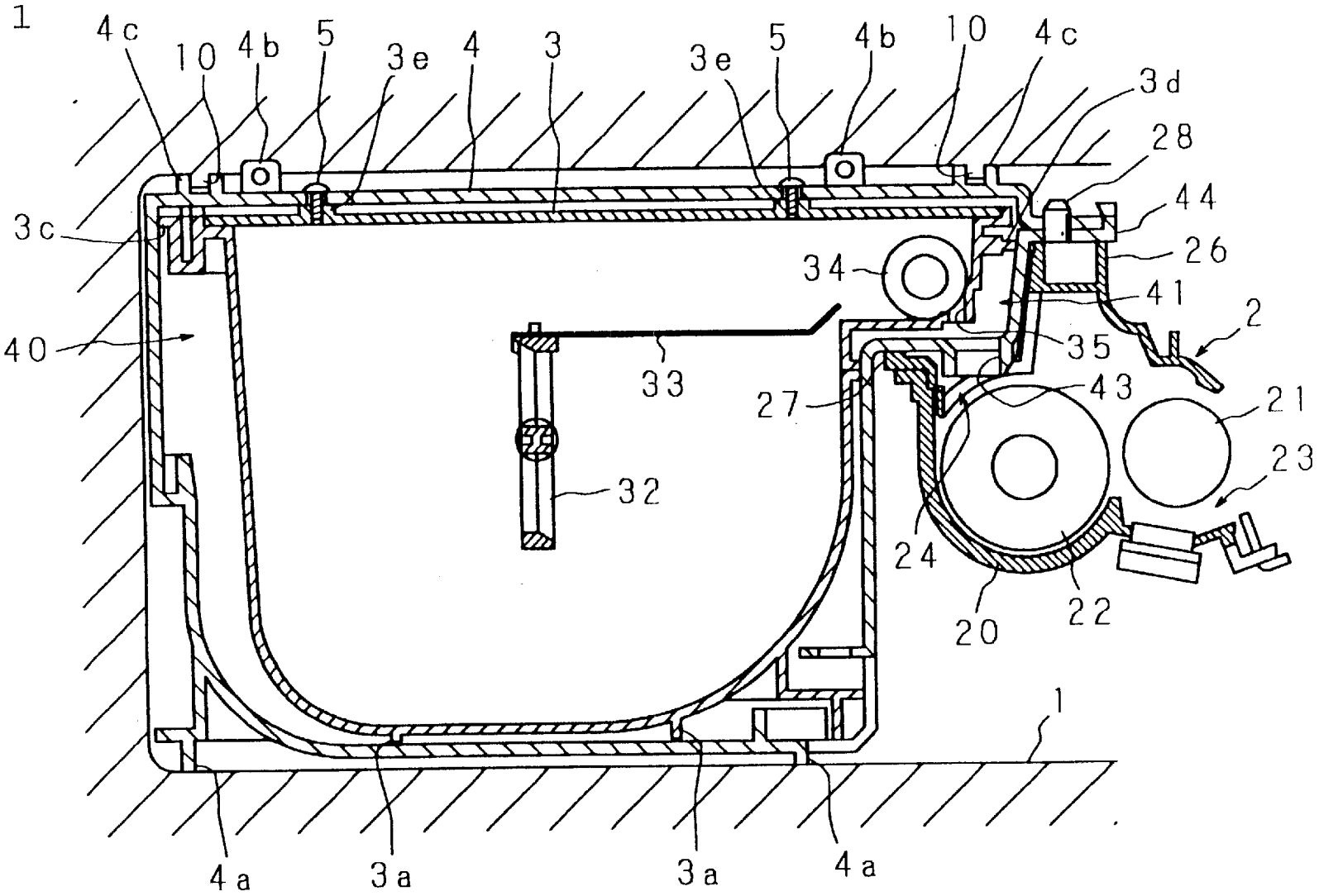
FIG. 1 is a sectional side view showing the structure of the first arrangement of a process cartridge according to the present invention.
Figure 2:
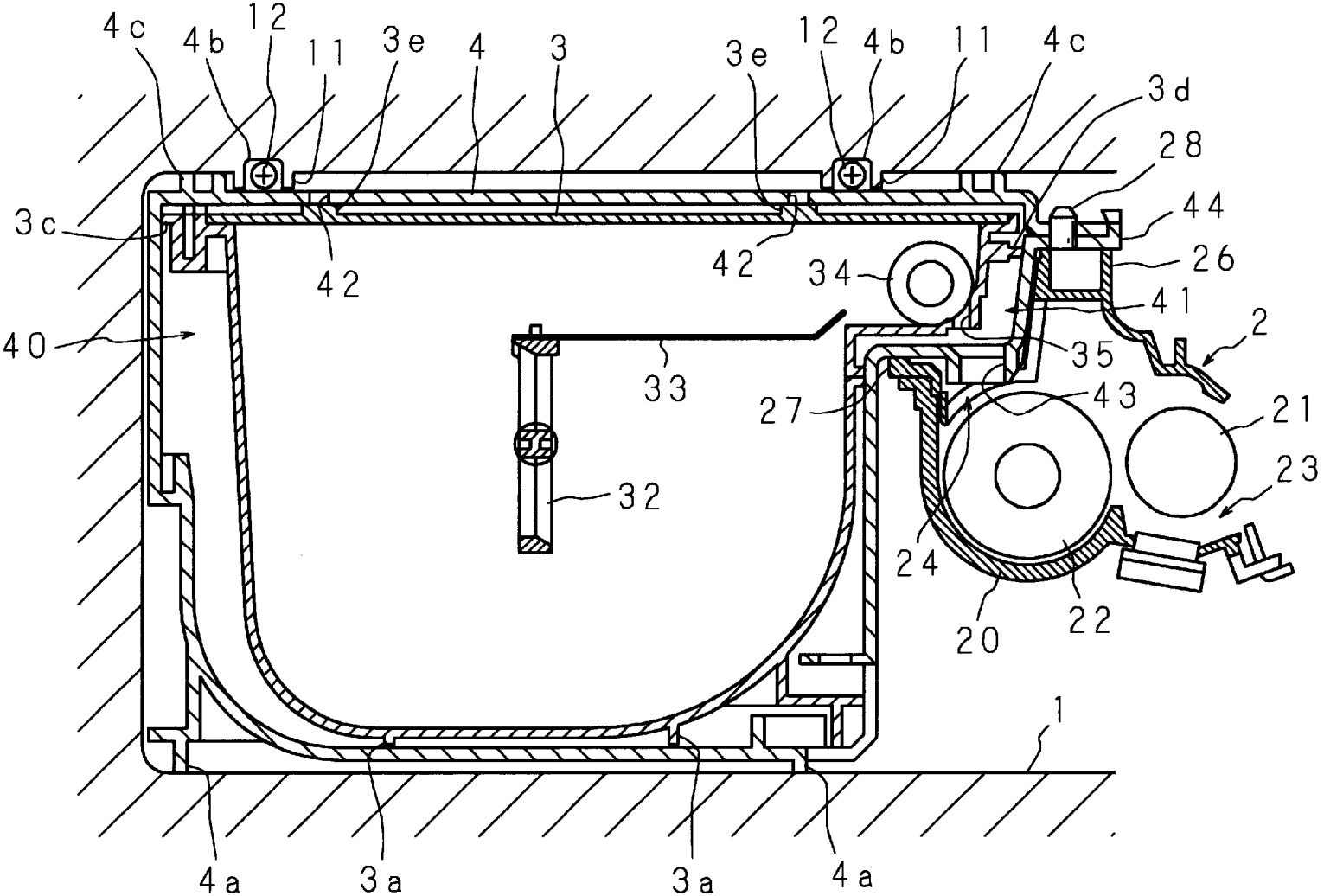
FIG. 2 is a sectional side view showing the structure of the second arrangement of a process cartridge according to the present invention.

FIGS. 1 and 2 are sectional side views showing the structures of process cartridges according to the present invention. As shown in these drawings, a process cartridge according to the present invention is constructed by a development unit 2, a toner unit 3, and a holding frame 4 that is formed as a separate body with respect to the above units.

Figure 3:
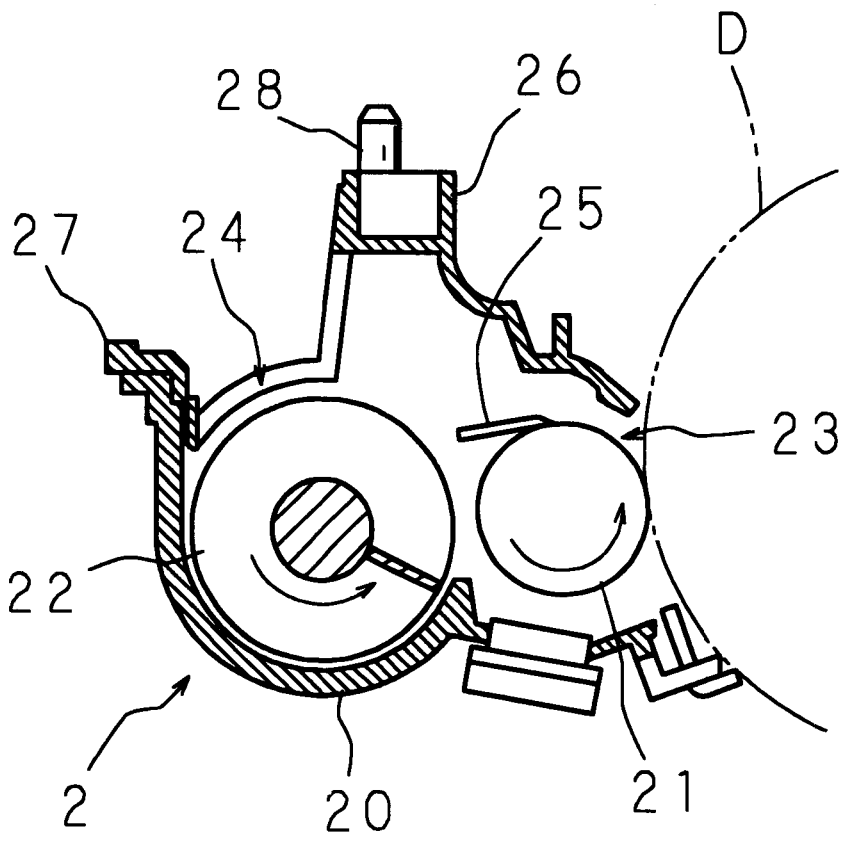
FIG. 3 is a sectional side view of a development unit.

FIG. 3 is a sectional side view of the development unit 2. As shown in FIG. 3, the development unit 2 is constructed by installing and supporting a development roller 21 and an agitating roller 22 that rotate about mutually parallel axes in a housing 20. The development roller 21 is a magnet roller incorporating a magnet. The development roller 21 is disposed so that a part of its circumferential surface appears over the entire length from a window opening 23 formed on one side of the housing 20. Besides, the agitating roller 22 is positioned in an agitating space which is formed to have a circular-arc-shaped base below a toner opening 24 that opens upward.

The window opening 23 is formed so that the circumferential surface of the development roller 21 appearing therefrom faces the circumferential surface of a photosensitive drum D indicated by the alternate long and two short dashes line in FIG. 3. Besides, the toner opening 24 is formed to receive toner for development supplied from the toner unit 3 as to be described later.

The development unit 2 constructed as described above distributes toner introduced from the toner opening 24 into the housing 20 in the axial direction (a direction perpendicular to the plane of the paper) by rotation of the agitating roller 22 constructed as a screw roller while mixing and agitating the toner and a carrier made of a magnetic powder. The development unit 2 deposits the toner evenly on the circumferential surface of the development roller 21 and transfers the toner by the rotation of the development roller 21.

The toner thus transferred is attracted and moved to an electrostatic latent image formed on the surface of the facing photosensitive drum D at a section where the development roller 21 appears from the window opening 23, thereby visualizing the electrostatic latent image. Meanwhile, the carrier and toner which were not attracted and remain on the circumferential surface of the development roller 21 are removed by the function of a scraper 25 attached slidably on the downstream side of the circumferential surface, and moved back into the housing 20 for reuse.

In addition, the development unit 2 constructed as described above includes a supporting edge 26 projecting upward on one side of the toner opening 24 that opens at an upper portion of the housing 20 and a supporting edge 27 projecting sideways on the other side of the toner opening 24, and positioning pins 28 are provided on the upper face of the supporting edge 26 to project from a plurality of points in a cross direction.

Figure 4:
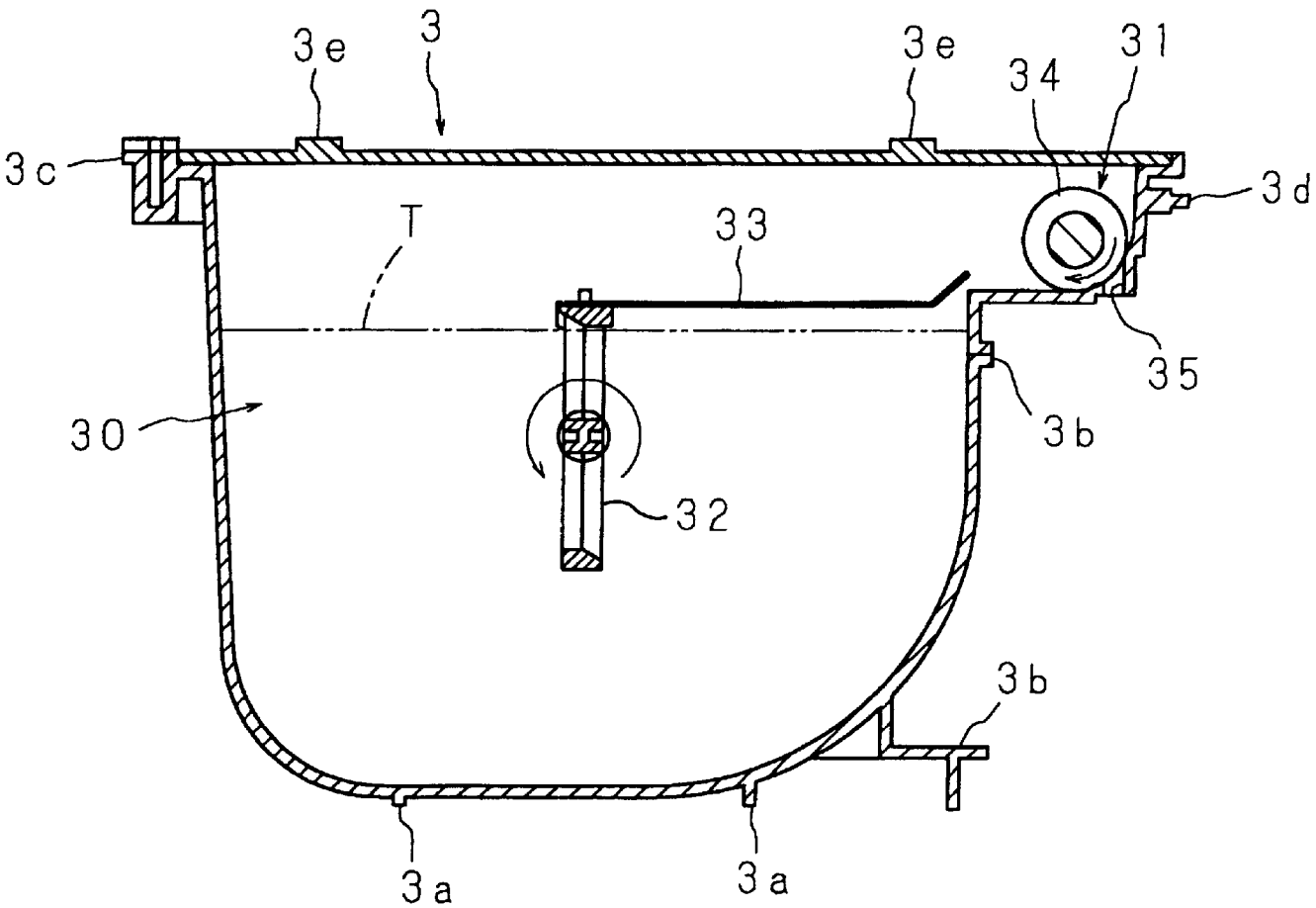
FIG. 4 is a sectional side view of a toner unit.

FIG. 4 is a sectional side view of the toner unit 3. As shown in FIG. 4, the toner unit 3 is constructed by connecting a small-volume toner supply space 31 to one side of the upper portion of a large-volume toner containing space 30 having a pot-like cross section.

As shown by the alternate long and two dashes line in FIG. 4, toner T for use in development is stored in the toner containing space 30, in a predetermined depth from the bottom face. Moreover, an agitator 32 as agitating means is installed laterally at substantially the center of the toner containing space 30. For the agitator 32, a highly elastic Mylar blade 33 is attached to one end of a blade body formed to protrude from both sides of a spindle. The Mylar blade 33 rotates in the direction indicated by an arrow in FIG. 4 so as to agitate the toner T. Moreover, the Mylar blade 33 is constructed so as to feed an appropriate amount of the toner T into the toner supply space 31.

In the toner supply space 31, a supply roller 34 constructed as a sponge roller by winding a sponge round the entire outer circumference is installed laterally. In addition, a toner outlet 35 through the bottom face is formed below the supply roller 34, on a side away from the toner containing space 30. The supply roller 34 rotates in the direction indicated by an arrow in FIG. 4. The supply roller 34 acts to successively output through the toner outlet 35 the toner T fed into the toner supply space 31 by the rotation of the agitator 32.

A pair of support legs 3*a*, 3*a* are provided on the outside of the toner unit 3 thus constructed so that they protrude from the lower face of the toner containing space 30. Besides, a pair of guide protrusions 3*b*, 3*b* are provided on upper and lower portions of one side face, while a guide protrusion 3*c* is formed to protrude from an upper edge of the other side face. Further, a guide protrusion 3*d* is formed to protrude from a side face of the toner supply space 31. On the other hand, short wide fixture seats 3*e*, 3*e* are provided on the upper face of the toner unit 3 to protrude from two locations appropriately separated in the cross direction of the toner containing space 30.

Figure 5:
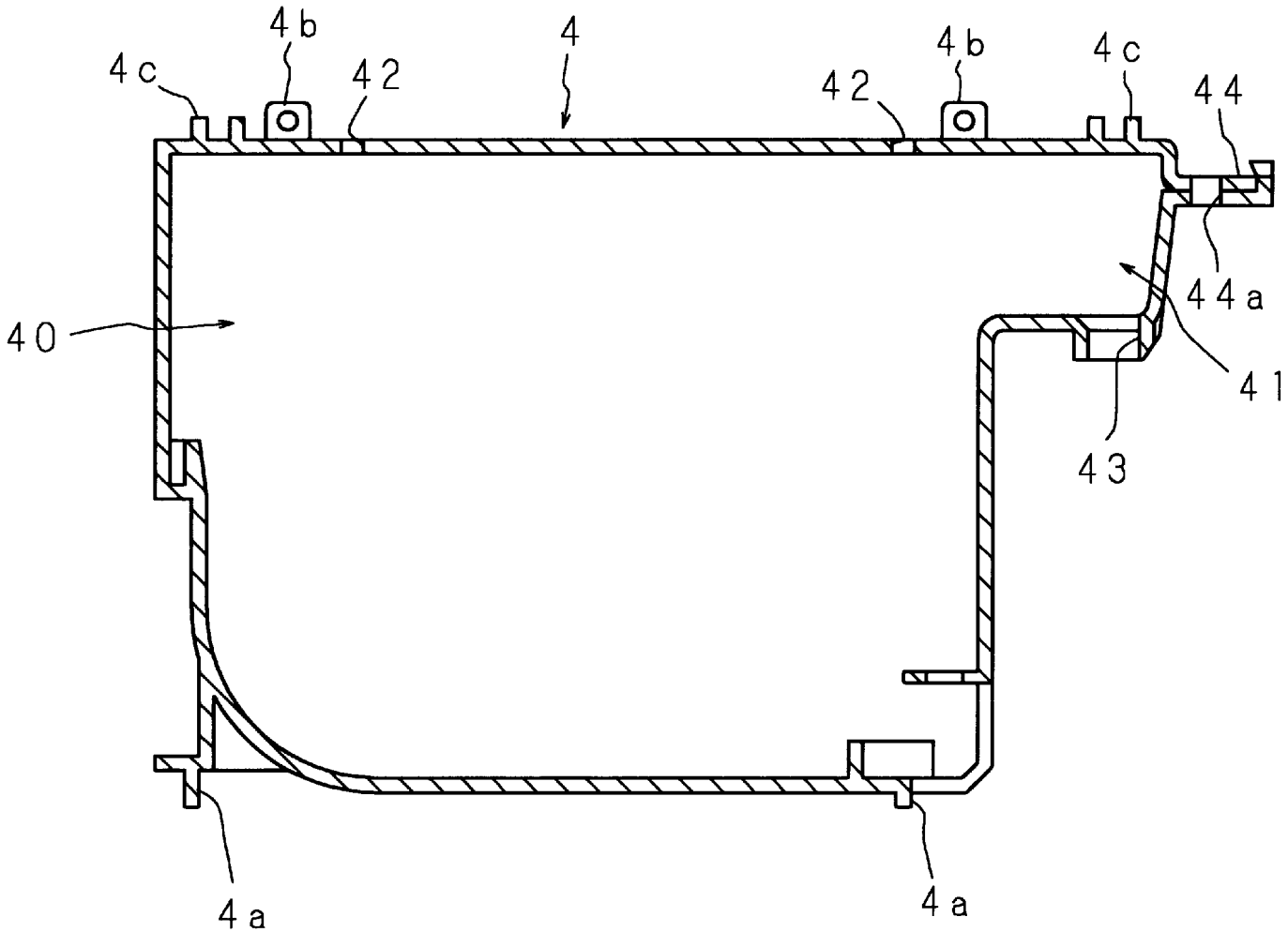
FIG. 5 is a sectional side view of a holding frame.

FIG. 5 is a sectional side view of the holding frame 4. The holding frame 4 has a first accepting section 40 capable of accepting the toner containing space 30 of the toner unit 3. Moreover, a second accepting section 41 capable of accepting the toner supply space 31 is provided on one side of the first accepting section 40. The holding frame 4 is constructed as a frame whose front side is entirely open.

Set-screw holes 42, 42 are formed in the upper face of the first accepting section 40 to run through the upper face at positions corresponding to the respective fixture seats 3*e*, 3*e* on the upper face of the toner unit 3. Additionally, a communicating hole 43 running through the bottom face of the second accepting section 41 is formed in an end of the bottom face at a position corresponding to a position on the lower face of the toner supply space 31 where the toner outlet 35 is formed. A fixture flange 44 for fixing the development unit 2 is formed on an outside upper portion of the end wall of the second accepting section 41 so that it projects outward. A positioning hole 44*a* is formed in the fixture flange 44 to run through a position corresponding to the positioning pin 28 protruding from the supporting edge 26 on the upper portion of the development unit 2.

Further, a pair of support legs 4*a*, 4*a* are provided to protrude from the outer side of the holding frame 4 at positions below the first accepting section 40. Above the first accepting section 40, a pair of fixture flanges 4*b*, 4*b* are provided on both sides of the set-screw holes 42, 42 to protrude from the outer side of the holding frame 4. In addition, a pair of guide sections 4*c*, 4*c* are formed on both sides of these fixture flanges 4*b*, 4*b*.

The fixture flanges 4*b*, 4*b* are flat plate-like members whose front faces coincide with the plane of the paper. A set-screw hole running through the front and rear faces is formed at substantially the center of each fixture flange 4*b*.

Besides, each of the guide sections 4*c*, 4*c* is constructed by extending two protruding bars that face each other with a predetermined space therebetween in the cross direction along a direction orthogonal to the plane of the paper.

The process cartridge according to the present invention is a combination of the development unit 2, toner unit 3 and holding frame 4 as described above, and is selectively used in the first arrangement shown in FIG. 1 or the second arrangement shown in FIG. 2.

In the first arrangement shown in FIG. 1 and the second arrangement shown in FIG. 2, the development unit 2 is supported and fixed by the fixture flange 44 of the holding frame 4. The upper face of the supporting edge 26 of the development unit 2 is placed in position by bringing the upper face into contact with the lower face of the fixture flange 44. The upper face of the supporting edge 27 is placed in position by bringing the upper face into contact with the lower face of the second accepting section 41. The positioning pin 28 protruding from the supporting edge 26 is placed in position by fitting it into the positioning hole 44*a* running through the fixture flange 44. Accordingly, as shown in the drawings, the toner opening 24 formed in the development unit 2 is positioned below the communicating hole 43 formed in the bottom face of the second accepting section 41 of the holding frame 41.

On the other hand, the toner unit 3 is fixed in the holding frame 4 in the first arrangement shown in FIG. 1, while it is detachably installed in the holding frame 4 in the second arrangement shown in FIG. 2.

In the first arrangement, the toner unit 3 is inserted into the holding frame 4. The fixture seats 3*e*, 3*e* protruding from the upper positions of the toner containing space 30 are set inside of the set-screw holes 42, 42 formed in the upper face of the holding frame 4. Set-screws 5, 5 inserted into these set-screw holes 42, 42 from the upper part of the holding frame 4 are screwed into the screw holes formed in the center of the respective fixture seats 3*e*, 36*e*.

The support legs 3*a*, 3*a* protruding from the lower positions of the toner containing space 30 come into contact with the bottom face of the first accepting section 40. Moreover, the guide protrusions 3*b*, 3*b* and guide protrusion 3*c* protruding from both side faces of the toner containing space 30 come into contact with the inner face of the first accepting section 40. The guide protrusion 3*d* protruding from the side face of the toner supply space 31 comes into contact with the inner face of the second accepting section 41. Accordingly, the toner unit 3 is accurately placed in a predetermined position in the holding frame 4. At this time, as shown in the drawings, the toner outlet 35 running through the bottom face of the toner supply space 31 is positioned above the communicating hole 43 running through the bottom face of the second accepting section 41 of the holding frame 4. The toner T outputted through the toner outlet 35 by the rotation of the supply roller 34 in the toner supply space 31 falls through the communicating hole 43. The toner T is surely supplied to the development unit 2 through the toner opening 24 positioned below the communicating hole 43.

Such a process cartridge of the first arrangement is used by installing the holding frame 4 comprising the development unit 2 and the toner unit 3 integrally mounted therein in a receiving recession 1 provided at an appropriate position in the main body of the image forming apparatus. Guide rails 10, 10 formed at appropriate positions on the top face of the receiving recession 1 are fitted into the gaps in the guide sections 4*c*, 4*c* extended in the depth direction on the upper face of the holding frame 4. The installation is achieved by pushing the holding frame 4 in the depth direction by the functions of these guides.

The holding frame 4 installed in such a manner is placed in position in the vertical direction by bringing the pair of support legs 4*a*, 4*a* protruding from the lower outer face into contact with the bottom face of the receiving recession 1. Further, the holding fame 4 is placed in position in the right-left direction by the guide rails 10, 10 fitted into the gaps in the guide sections 4*c*, 4*c*. As a result, as shown in FIG. 3, the circumferential face of the development roller 21 appearing from the window opening 23 on one side of the development unit 2 adjoins and faces the surface of the photosensitive drum D. Moreover, it is possible to certainly perform the above-described development operation of the development unit 2.

When the toner T is consumed by repetition of this development operation, the holding frame 4 is pulled out in a sequence reverse to the above-described sequence for installation. Then, the development unit 2 and toner unit 3 are replaced together. In other words, the process cartridge of the first arrangement is applicable to image forming apparatuses having the above-mentioned CRU structure.

On the other hand, in the second arrangement, installation of the toner unit 3 is achieved by pushing the toner unit 3 in the depth direction from an opening in the front side into the holding frame 4. At this time, the support legs 3*a*, 3*a* protruding from the lower positions of the toner containing space 30 come into contact with the bottom face of the first accepting section 40. The fixture seats 3*e*, 3*e* protruding from the upper positions come into contact with the top face of the first accepting section 40. Accordingly, the toner unit 3 is placed in position in the vertical direction. Moreover, the guide protrusions 3*b*, 3*b* and the guide protrusion 3*c* protruding from both side faces of the toner containing space 30 respectively come into contact with the inner face of the first accepting section 40. The guide protrusion 3*d* protruding from the side face of the toner supply space 31 comes into contact with the inner face of the second accepting section 41. Accordingly, the toner unit 3 is placed in position in the right-left direction. With the pushing of the toner unit 3 by these guides, the toner unit 3 is accurately placed in a predetermined position in the holding frame 4. Note that the fixture seats 3*e*, 3*e* are used as the above-mentioned guide sections.

Such a process cartridge of the second arrangement is used by fixing the holding frame 4 integrated with the development unit 2 in the receiving recession 1 provided at an appropriate position in the main body of the image forming apparatus. The support legs 4*a*, 4*a* protruding from the lower portion of the holding frame 4 are supported by bringing them into contact with the bottom face of the receiving recession 1. On the other hand, the fixture flanges 4*b*, 4*b* protruding from the upper portion of the holding frame 4 are respectively aligned with fixture seats 11, 11 hanged from the top face of the receiving recession 1. The set-screws 12, 12 are inserted through the screw holes in the center of the respective fixture flanges 4*b*, 4*b* and are screwed into the fixture seats 11, 11, respectively.

It is possible to make slight adjustments for the fixed position of such a holding frame 4 within an allowable range of the fastening positions of the set-screws 12, 12. The development unit 2 supported and fixed on one side of the holding frame 4, more specifically, a circumferential position of the development roller 21 appearing from the window opening 23 of the development unit 2 can be placed in position with high accuracy with respect to the surface of the photosensitive drum D. It is therefore possible to satisfactorily maintain the above-described development environment given by the development unit 2 and form high-quality images.

When the toner T is consumed by repetition of such a development operation, the toner unit 3 is pulled out of the holding frame 4 fixed to the main body of the image forming apparatus, in a sequence reverse to the above-described sequence for installation. Then, only the toner unit 3 is replaced. In other words, the process cartridge of the second arrangement is applicable to image forming apparatuses having the above-mentioned SRU structure.

A toner unit 3 for replacement is installed with high positioning accuracy by the above-mentioned guide function associated with the holding frame 4. Like the first arrangement, the toner outlet 35 running through the bottom face of the toner supply space 31 is positioned above the communicating hole 43 formed in the bottom face of the second accepting section 41 of the holding frame 4. The toner T outputted by the rotation of the supply roller 34 in the toner supply space 31 falls through the toner outlet 35 and the communicating hole 43. Hence, the toner T is surely supplied into the development unit 2 through the toner opening 24 positioned below the communicating hole 43.

It should be noted that, in the above-described second arrangement, the guide sections 4*c*, 4*c* protruding from the upper face of the holding frame 4 can be used to limit the movement of the holding frame 4 in the vertical direction by bringing the guide sections 4*c*, 4*c* into contact with the top face of the receiving recession 1. Moreover, in the first arrangement, the fixture flanges 4*b*, 4*b* protruding from the upper face of the holding frame 4 can be used as stoppers for positioning in the depth direction by bringing the fixture flanges 4*b*, 4*b* into contact with the circumferential edge of the receiving recession 1.

Embodiment 2

Figure 6:
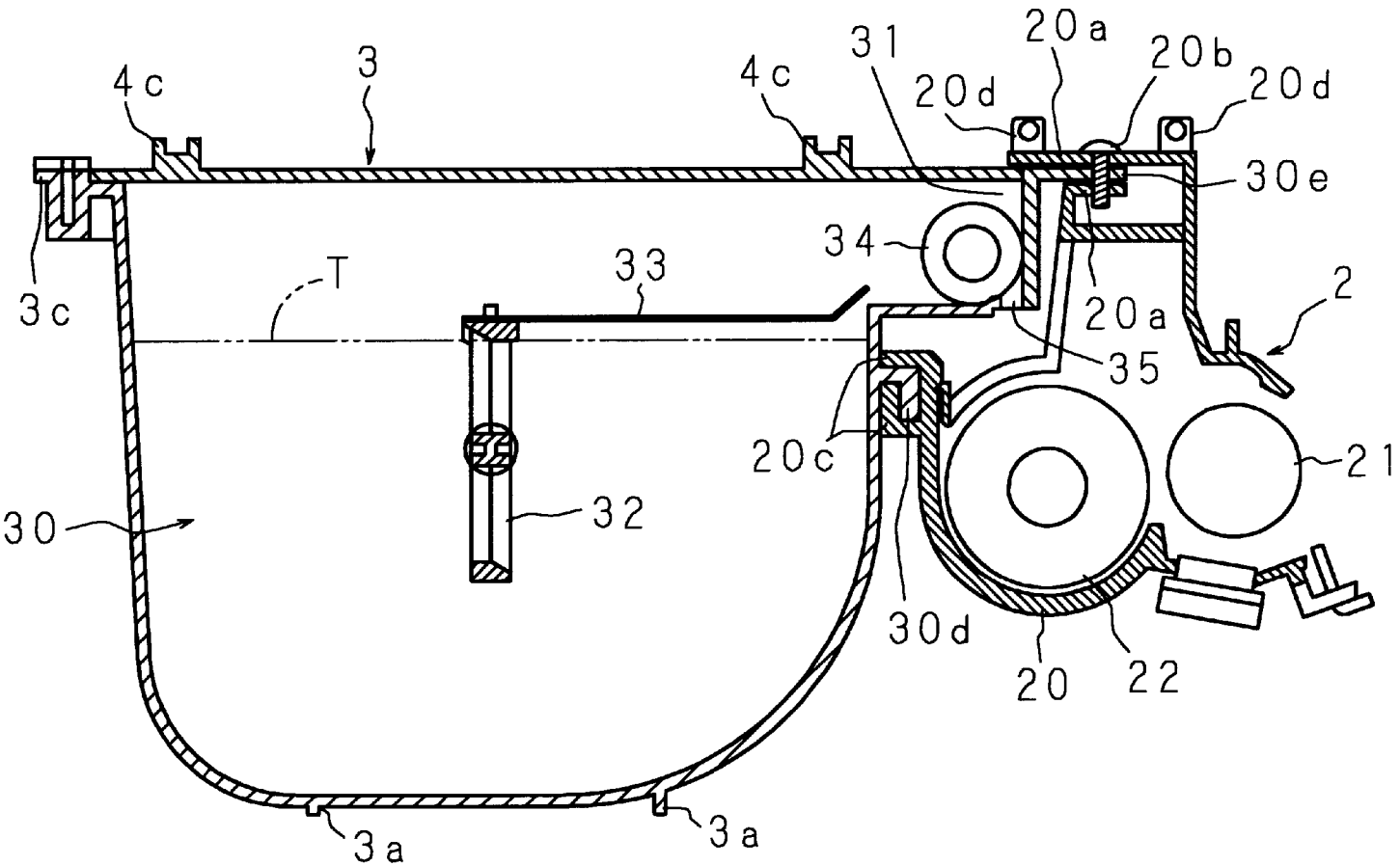
FIG. 6 is a sectional side view showing the development unit and toner unit according to the third arrangement.

FIG. 6 is a sectional side view of the development unit 2 and toner unit 3 according to the third arrangement. As shown in FIG. 6, a pair of guide sections 4*c*, 4*c* are provided to protrude from the upper part of the toner unit 3, and a first guide protrusion 30*e* is formed to extend in the direction of the development unit 2. A first coupling section 20*a* to be coupled with the first guide protrusion 30*e* is provided at an upper portion of the development unit 2. Moreover, a second guide protrusion 30*d* is formed at substantially the center of the toner unit 3 to extend in the direction of the development unit 2, and correspondingly a second coupling section 20*c* to be coupled with the second guide protrusion 30*d* is formed at substantially the center of the development unit 2.

The first guide protrusion 30*e*, the first coupling section 20*a*, the second guide protrusion 30*d* and the second coupling section 20*c* extend in a direction perpendicular to the plane of the paper. The toner unit 3 is installed by inserting the first guide protrusion 30*e* and second guide protrusion 30*d* of the toner unit 3 in a sliding manner into the first coupling section 20*a* and the second coupling section 20*c* of the development unit 2. Screw holes, not shown, are formed coaxially at predetermined positions in the first guide protrusion 30*e* and first coupling section 20*a* to couple them with a screw 20*d*.

Moreover, a pair of fixture flanges 20*d*, 20*d* are provided to protrude from the upper portion of the development unit 2. The fixture flanges 20*d*, 20*d* are flat plate-like members whose front faces coincide with the plane of the paper, and a set-screw hole running through the front and back surfaces is formed at the center of each fixture flange 20*d*.

Figure 7:
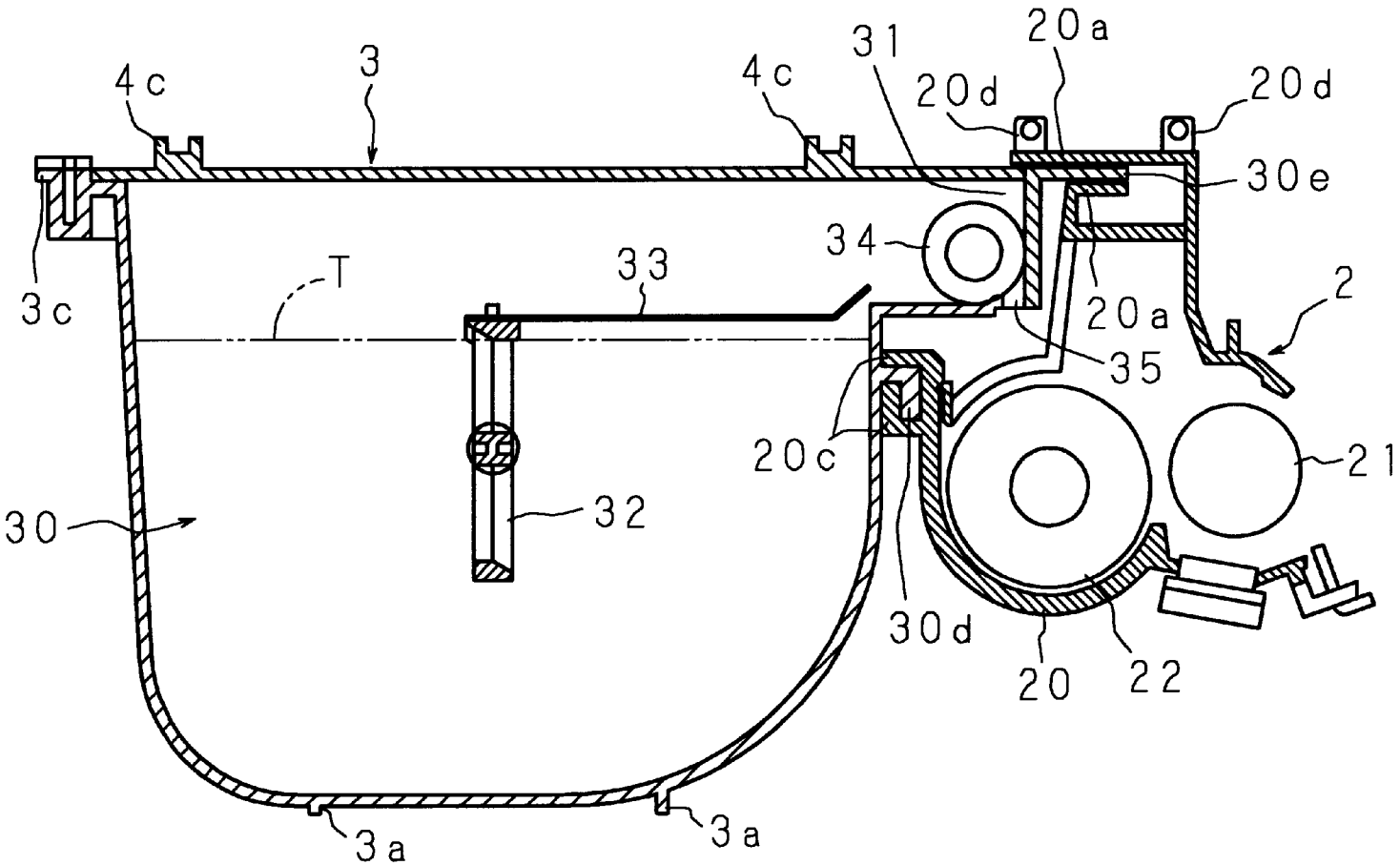
FIG. 7 is a sectional side view showing the development unit and toner unit according to the fourth arrangement.

FIG. 7 is a side sectional view of the development unit 2 and toner unit 3 according to the fourth arrangement. As shown in FIG. 7, the fundamental structures are the same as those of the development unit 2 and toner unit 3 according to the third arrangement shown in FIG. 6. In the fourth arrangement, however, the toner unit 3 is installed by sliding the first guide protrusion 30*e* and second guide protrusion 30*d* of the toner unit 3 into the first coupling section 20*a* and second coupling section 20*c* of the development unit 2, without using the screw 20*b*.

Figure 8:
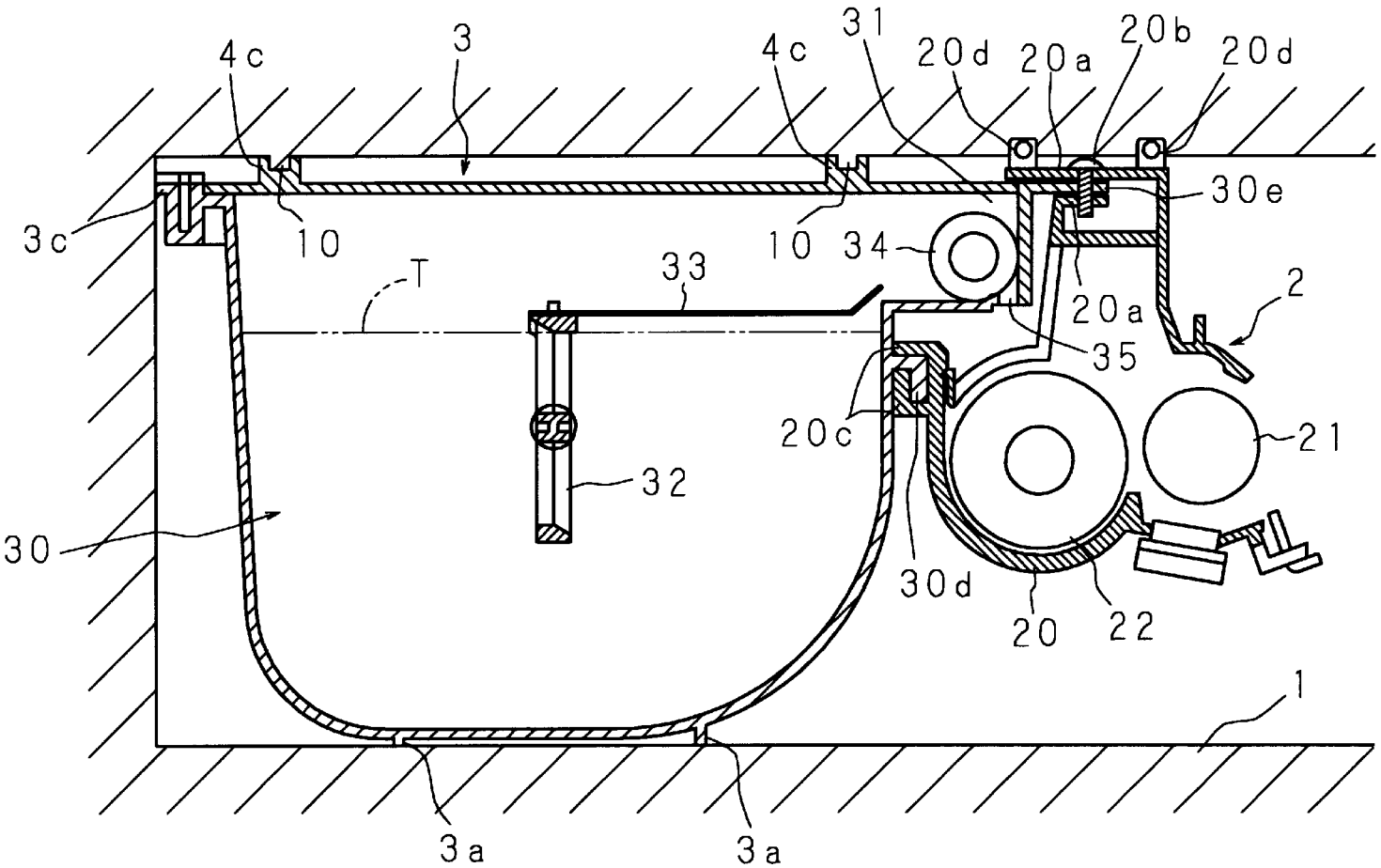
FIG. 8 is a sectional side view showing the structure of the third arrangement of the process cartridge of the present invention.

FIG. 8 is a side sectional view showing the structure of the third arrangement of the process cartridge according to the present invention. As shown in FIG. 8, the toner unit 3 and the development unit 2 are coupled by the screw 20*b*. The process cartridge of the third arrangement integrated in this manner is used by installing it in the receiving recession 1 provided at an appropriate position in the main body of the image forming apparatus. The toner unit 3 is installed by fitting the guide rails 10, 10 into the gaps in the guide sections 4*c*, 4*c* and pushing the toner unit 3 and development unit 2 in the depth direction by the functions of these guides.

The toner unit 3 and development unit 2 installed in this manner are placed in position in the vertical direction by bringing a pair of support legs 3*a*, 3*a* protruding from the lower outer face into contact with the bottom face of the receiving recession 1. Further, the toner unit 3 and development unit 2 are placed in position in the right-left direction by the guide rails 10, 10 fitted into the gaps in the guide sections 4*c*, 4*c* . As a result, as shown in FIG. 3, the circumferential face of the development roller 21 appearing from the window opening 23 on one side of the development unit 2 adjoins and faces the surface of the photosensitive drum D. Moreover, it is possible to certainly perform the above-described development operation of the development unit 2.

When the toner T is consumed by repetition of this development operation, the integrated toner unit 3 and development unit 2 are pulled out in a sequence reverse to the above-described sequence for installation. Thus, the development unit 2 and toner unit 3 are replaced together. In other words, the process cartridge of the third arrangement is applicable to image forming apparatuses having the above-mentioned CRU structure.

Figure 9:
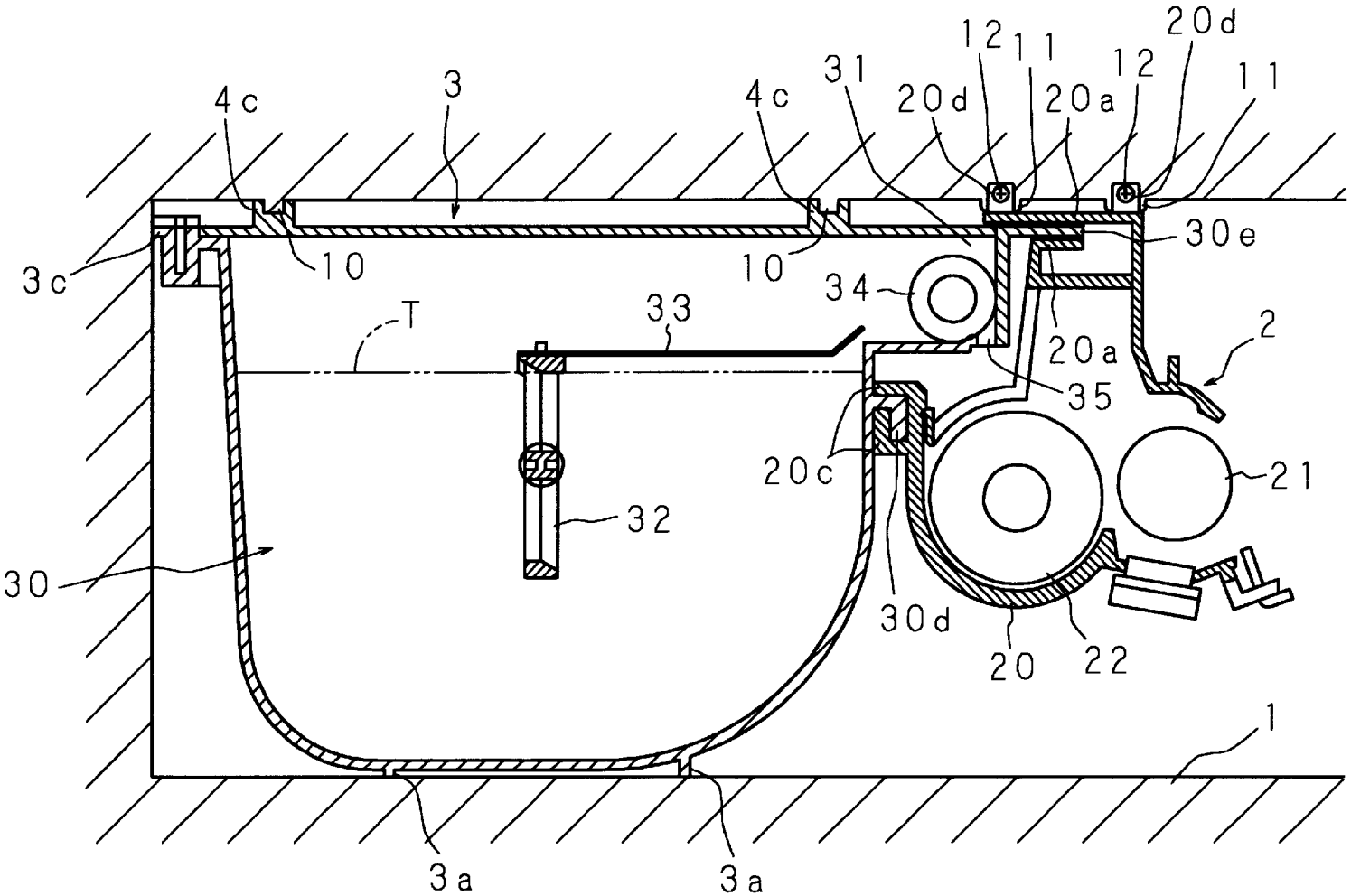
FIG. 9 is a sectional side view showing the structure of the fourth arrangement of the process cartridge of the present invention.

FIG. 9 is a side sectional view showing the structure of the fourth arrangement of the process cartridge according to the present invention. The toner unit 3 in the fourth arrangement is installed by inserting the first guide protrusion 30*e* and second guide protrusion 30*d* of the toner unit 3 in a sliding manner into the first coupling section 20*a* and second coupling section 20*c* of the development unit 2. At this time, the toner unit 3 is placed in position in the vertical direction by bringing the support legs 3*a*, 3*a* protruding at the lower positions of the toner containing space 30 into contact with the bottom face of the receiving recession 1. Besides, the toner unit 3 is placed in position in the right-left direction by respectively bringing the guide protrusions 3*b*, 3*b* and the guide protrusion 3*c* protruding from both side faces of the toner containing space 30 into contact with the inner face of the receiving recession 1. With the pushing of the toner unit 3 by these guides, the toner unit 3 is accurately installed in a predetermined position.

Such a process cartridge of the fourth arrangement is used by fixing the development unit 2 in the receiving recession 1 provided at an appropriate position in the main body of the image forming apparatus. The fixture flanges 20*d*, 20*d* are respectively aligned with the fixture seats 11, 11 hanged from the top face of the receiving recession 1. The set-screws 12, 12 inserted through the screw holes in the center of these fixture flanges 20*d*, 20*d* are screwed into the fixture seats 11, 11, respectively. Consequently, the development unit 2 is fixed.

It is possible to make slight adjustments for the fixed position of such a development unit 2 within an allowable range of the fastening positions of the set-screws 12, 12. The circumferential position of the development roller 21 appearing from the window opening 23 of the development unit 2 can be set in position with high accuracy with respect to the surface of the photosensitive drum D. It is therefore possible to satisfactorily maintain the above-described development environment given by the development unit 2 and form high-quality images.

When the toner T is consumed by repetition of such a development operation, the toner unit 3 is pulled out of the development unit 2 fixed to the main body of the image forming apparatus, in a sequence reverse to the above-described sequence for installation. Then, only the toner unit 3 is replaced. In other words, the process cartridge of the fourth arrangement is applicable to image forming apparatuses having the above-mentioned SRU structure.

Embodiment 2 has the above-described structures, and, since other structures and functions are the same as those of Embodiment 1, the corresponding parts are designated with the same reference numbers and the detailed explanation thereof is omitted.

Embodiment 3

Figure 10:
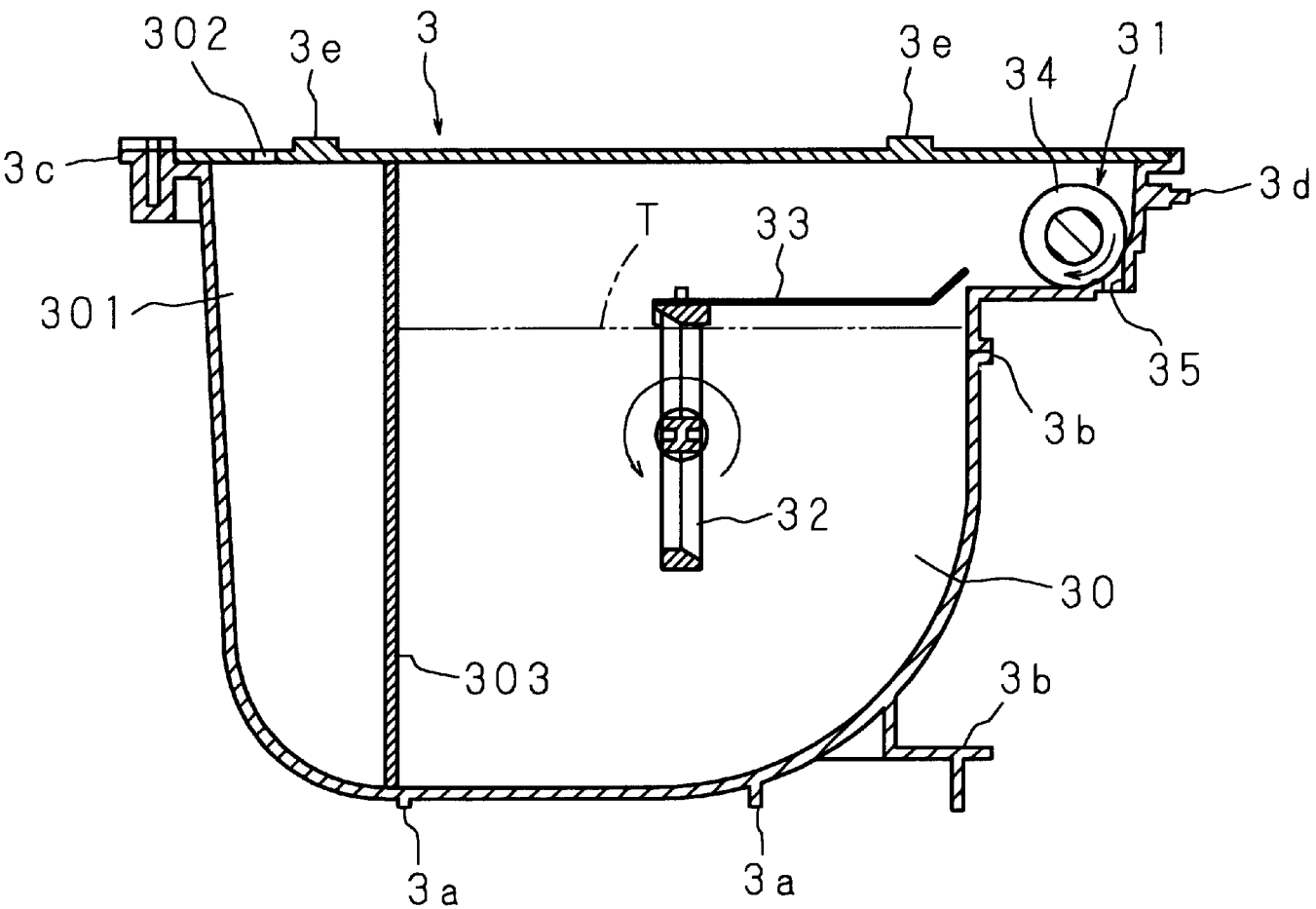
FIG. 10 is a sectional side view of the toner unit according to Embodiment 3.

FIG. 10 is a sectional side view of the toner unit 3 according to Embodiment 3. As shown in FIG. 10, the toner unit 3 according to Embodiment 3 is constructed by two independent spaces, namely, the toner containing space 30 and a waste toner storing space 301. The toner containing space 30 and the waste toner storing space 301 are separated by a partition wall 303. The ceiling portion of the waste toner storing space 301 has a toner collecting opening 302. Toner collected as non-transfer toner is collected in the waste toner storing space 301 via the toner collecting opening 302.

The toner unit 3 having the waste toner storing space 301 described in Embodiment 3 may be applied to the toner units 3 mentioned in Embodiments 1 and 2. Embodiment 3 has the above-described structures, and, since other structures and functions are the same as those of Embodiments 1 and 2, the corresponding parts are designated with the same reference numbers and the detailed explanation thereof is omitted.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A process cartridge for use in image forming apparatuses comprising:

a toner unit including a toner containing space and a toner supply space;

a development unit including rollers; and a holding frame including a fixture section for said development unit and an accepting section for said toner unit, wherein said process cartridge is constructed selectively in a first arrangement in which said toner unit is fixed in a predetermined position in the accepting section of said holding frame or in a second arrangement in which said toner unit is detachably installed in said predetermined position.

2. The process cartridge of claim 1, wherein said holding frame includes a fixture section for fixing said toner unit to said predetermined position, and guide sections for guiding said toner unit to said predetermined position.

3. The process cartridge of claim 2, wherein said holding frame includes a guide section for guiding itself to an appropriate position in an image forming apparatus main body in which said process cartridge is to be installed, and a fixture section for fixing itself to said appropriate position.

4. An image forming apparatus comprising:

a receiving recession for receiving a holding frame of a process cartridge of claim 2 constructed in said first arrangement, wherein replacement of toner and developer is performed by detachment and attachment of said holding frame with respect to said receiving recession.

5. An image forming apparatus, wherein a holding frame of a process cartridge of claim 2 constructed in said second arrangement is fixed in a predetermined position therein, and replacement of toner is performed by detachment and attachment of said toner unit with respect to said holding frame.

6. The process cartridge of claim 1, wherein said holding frame includes a guide section for guiding itself to an appropriate position in an image forming apparatus main body in which said process cartridge is to be installed, and a fixture section for fixing itself to said appropriate position.

7. An image forming apparatus comprising:

a receiving recession for receiving a holding frame of a process cartridge of claim 6 constructed in said first arrangement, wherein replacement of toner and developer is performed by detachment and attachment of said holding frame with respect to said receiving recession.

8. An image forming apparatus, wherein a holding frame of a process cartridge of claim 6 constructed in said second arrangement is fixed in a predetermined position therein, and replacement of toner is performed by detachment and attachment of said toner unit with respect to said holding frame.

9. An image forming apparatus comprising:

a receiving recession for receiving a holding frame of a process cartridge of claim 1 constructed in said first arrangement, wherein replacement of toner and developer is performed by detachment and attachment of said holding frame with respect to said receiving recession.

10. An image forming apparatus, wherein a holding frame of a process cartridge of claim 1 constructed in said second arrangement is fixed in a predetermined position therein, and replacement of toner is performed by detachment and attachment of said toner unit with respect to said holding frame.

11. The process cartridge of claim 1, wherein said toner unit further comprises a waste toner storing space for storing toner collected as non-transfer toner.

12. A process cartridge for use in image forming apparatuses comprising:

a toner unit including a toner containing space and a toner supply space; and a development unit including rollers, wherein said process cartridge is constructed selectively in a main arrangement in which said toner unit and said development unit are fixed at a coupling section or in a sub-arrangement in which said toner unit and said development unit are detachably attached in a sliding manner into said coupling section.

13. An image forming apparatus comprising:

a receiving recession for receiving a process cartridge of claim 12 constructed in said main arrangement and sub-arrangement, wherein said toner unit and said development unit are attachable and detachable as one unit with respect to said receiving recession.

14. An image forming apparatus comprising:

a receiving recession for receiving a process cartridge of claim 12, wherein said toner unit and development unit are detachable and detachable as separate units with respect to said receiving recessions.

15. A process cartridge for use in image forming apparatuses comprising:

a toner unit including a toner containing space and a toner supply space; and a development unit including rollers, wherein said process cartridge is constructed selectively in a main arrangement in which said toner unit and said development unit are fixed or in a sub-arrangement in which said toner unit and said development unit are detachably attached, wherein said toner unit further comprises a waste toner storing space for storing toner collected as non-transfer toner.

16. A process cartridge for use in image forming apparatuses comprising:

a toner unit including a toner containing space and a toner supply space; and a development unit including rollers; and the toner unit and the development unit being in direct physical contact to a holding frame and are detachable with respect to the holding frame.

17. A process cartridge for use in image forming apparatuses comprising:

a toner unit including a toner containing space, a developing unit including rollers, wherein the toner unit and the developing unit are detachable; and the toner unit further comprises a waste toner storing space for storing toner collected as non-transfer toner.

* * * * *